US007562791B2

(12) United States Patent
Yuyama et al.

(10) Patent No.: US 7,562,791 B2
(45) **Date of Patent: *Jul. 21, 2009**

(54) TABLET FILLING DEVICE

(75) Inventors: Shoji Yuyama, Osaka (JP); Naoki Koike, Osaka (JP); Tasuku Minami, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/885,062

(22) PCT Filed: Feb. 23, 2006 (Under 37 CFR 1.47)

(86) PCT No.: PCT/JP2006/303235

§ 371 (c)(1), (2), (4) Date: Aug. 24, 2007

(87) PCT Pub. No.: WO2006/090763

PCT Pub. Date: Aug. 31, 2006

(65) Prior Publication Data

US 2008/0164281 A1 Jul. 10, 2008

(30) Foreign Application Priority Data

Feb. 25, 2005 (JP) ..... 2005-050859

(51) Int. Cl.
*B65H 1/00* (2006.01)

(52) U.S. Cl. ..... 221/265; 221/287; 221/197; 221/258

(58) Field of Classification Search ..... 221/1–312 C; 700/231–244

See application file for complete search history.

(56) References Cited

U.S. PATENT DOCUMENTS

| | | | | |
|---|---|---|---|---|
| 5,884,806 | A * | 3/1999 | Boyer et al. | 221/75 |
| 6,006,946 | A * | 12/1999 | Williams et al. | 221/9 |
| 6,085,938 | A * | 7/2000 | Coughlin | 221/203 |
| 6,119,737 | A * | 9/2000 | Yuyama et al. | 141/104 |
| 6,349,848 | B1 | 2/2002 | Uema et al. | |

(Continued)

FOREIGN PATENT DOCUMENTS

| | | |
|---|---|---|
| JP | 11-070901 | 3/1999 |

(Continued)

*Primary Examiner*—Gene Crawford
*Assistant Examiner*—Michael K Collins
(74) *Attorney, Agent, or Firm*—Patterson, Thuente, Skaar & Christensen, P.A.

(57) ABSTRACT

To automatically eliminate clogging of tablets, a tablet filling device provides a cassette body including a tablet cassette, having tablets, a rotor having a groove for holding a tablet, and a discharge port for discharging the tablet held by the groove. The cassette body includes a worm gear in mesh with a gear fixed to a shaft of the rotor. A carrying member is adapted to approach the tablet cassette while holding a tablet container. The tablet filling device is equipped with a drive shaft engaged with the worm gear to rotate the rotor via the gear. The tablet container is carried to the tablet cassette by the carrying member and, when a rotation of the rotor stops halfway through dispensing of tablets, the worm gear is moved in the axial direction of the drive shaft of the carrying member to cause the rotor to make a reverse rotation.

3 Claims, 16 Drawing Sheets

U.S. PATENT DOCUMENTS

| | | | | |
|---|---|---|---|---|
| 6,516,969 | B2 * | 2/2003 | Tamaoki | 221/2 |
| 7,131,554 | B2 * | 11/2006 | Hashimoto | 221/197 |
| 7,228,198 | B2 * | 6/2007 | Vollm et al. | 700/235 |
| 7,258,248 | B2 * | 8/2007 | Kim | 221/203 |
| 7,303,094 | B2 * | 12/2007 | Hutchinson et al. | 221/197 |
| 7,395,946 | B2 * | 7/2008 | Yuyama et al. | 221/265 |
| 2002/0134790 | A1 * | 9/2002 | Tamaoki | 221/21 |

FOREIGN PATENT DOCUMENTS

| | | | |
|---|---|---|---|
| JP | 2000-103404 | | 4/2000 |
| JP | 2002-186658 | | 7/2002 |
| WO | WO 03/016138 | A1 | 2/2003 |
| WO | WO 2004/014288 | A1 | 2/2004 |
| WO | WO 2004/014734 | A1 | 2/2004 |

* cited by examiner

TABLET FILLING DEVICE

TECHNICAL FIELD

The present invention relates to a tablet filling device.

BACKGROUND ART

Conventionally, there has been available a tablet filling device which supplies a tablet container, which is filled with tablets from a tablet cassette by rotating a built-in rotor, the tablet container completely filled with tablets being carried to a position where the tablet container can be extracted (see, for example, Patent Document 1).

Patent Document 1: JP 11-70901 A

DISCLOSURE OF THE INVENTION

Problem to be Solved by the Invention

However, in the above-mentioned tablet filling device, when tablet clogging or the like occurs halfway through the filling of the tablet container with tablets from the tablet cassette and the rotor makes an emergency stop, there is nothing for it but to report an error and suspend the operation until manual maintenance is conducted.

In view of this, it is an object of the present invention to provide a tablet filling device capable of automatically eliminating tablet clogging before maintenance.

Means for Solving the Problem

With a view to solving the above-mentioned problem, the present invention provides a tablet filling device including: a tablet cassette which has, in a cassette main body accommodating tablets, a rotor rotatably provided and having a groove for holding a tablet, and in which a discharge port for discharging the tablet held by the groove is formed in the cassette main body, with the cassette main body being provided with a worm gear in mesh with a gear fixed to a shaft of the rotor protruding from a bottom of the cassette main body; and a carrying member adapted to approach the tablet cassette accommodating tablets to be extracted while holding a tablet container, and equipped with a drive shaft to be engaged with the worm gear to rotate the rotor via the gear, in which the worm gear is provided so as to be movable in the axial direction thereof, and in which the tablet container is carried to the tablet cassette by the carrying member and, when the rotation of the rotor stops halfway through dispensing of tablets, the worm gear is moved in the axial direction by the drive shaft of the carrying member to cause the rotor to make reverse rotation.

With this construction, when the rotor makes an emergency stop because of tablet clogging or the like, it is possible to automatically eliminate the tablet clogging by causing the rotor to make reverse rotation. Thus, it is possible to resume the rotation of the rotor without having to perform any maintenance.

Preferably, an urging member is provided for urging the worm gear in the axial direction thereof, in which, at the time of reverse rotation of the rotor, the drive shaft of the carrying member is moved against the urging force of the urging member.

With this construction, when the drive shaft is not moved, the worm gear is held in press contact with the gear provided on the rotor shaft by the urging force of the urging member.

Thus, it is possible to transmit the drive force of the drive shaft reliably from the worm gear to the rotor via the gear without involving generation of any backlash. Further, even when tablet clogging occurs, the urging member serves as a cushion, so the tablet suffers no damage.

It should be noted that, at the time of reverse rotation of the rotor, the direction in which the drive shaft of the carrying member is moved may be set to a direction in which the drive shaft is drawn in.

EFFECT OF THE INVENTION

According to the present invention, when the rotation of the rotor stops halfway through tablet discharge, the rotor is caused to make reverse rotation by the drive shaft from the worm gear via the gear, so tablet clogging or the like is efficiently eliminated, and it is possible to automatically resume dispensing of tablets without having to perform any maintenance.

DESCRIPTION OF REFERENCE SYMBOLS

Figure 1:
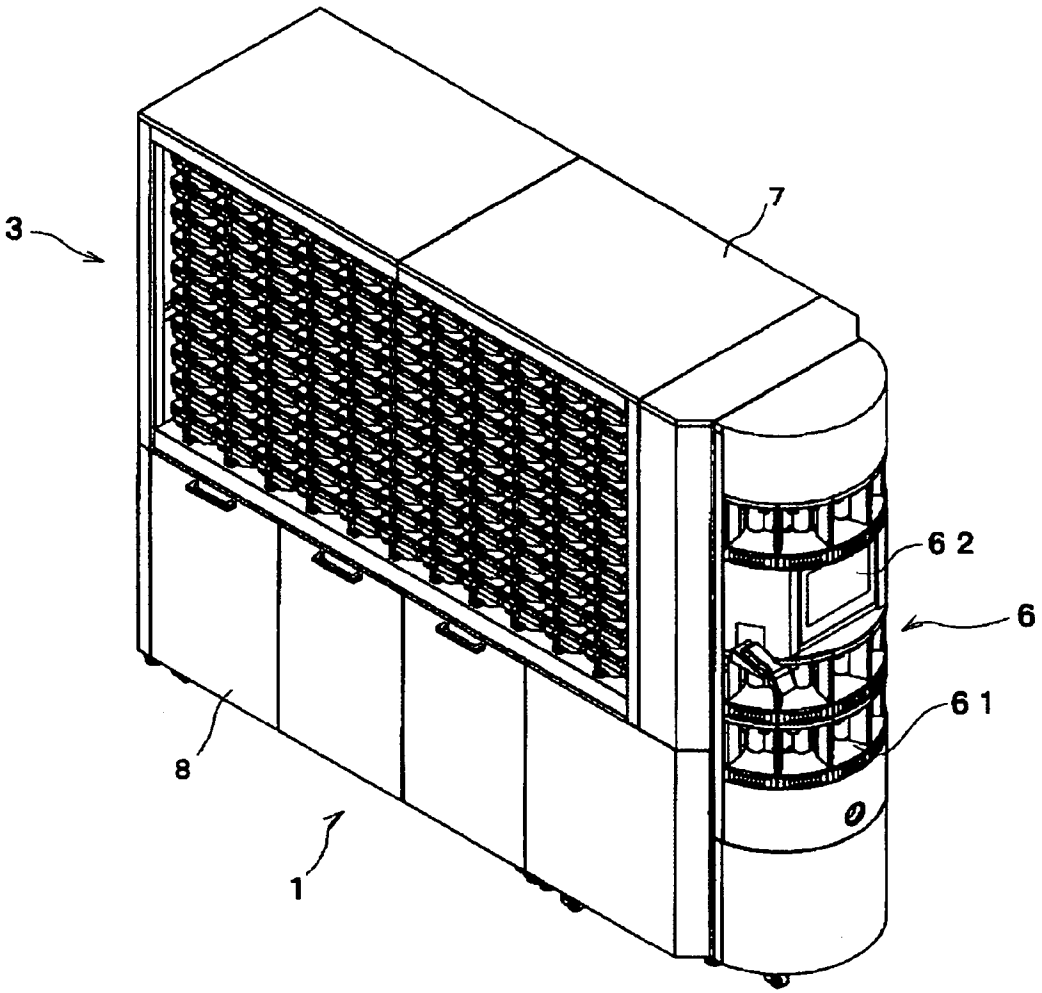
FIG. 1 is a perspective view of a tablet filling device according to the embodiment.

1: container supply unit
2: labeling unit
3: tablet supply unit
4: capping unit
5: carrying member
6: extraction unit
7: device main body
8: bucket

9: vial (tablet container)
10: support panel
10*a*: tablet outlet
10*b*: cover
11: tablet feeder
12: tablet cassette
13*a*: rotor
13*a*: conical surface
14: cassette main body
15: cover member
15*a*: shaft portion
15*b*: cutout portion
16: rotor accommodating portion
16*a*: engagement portion
17: tablet accommodating portion
17*a*, 17*b*: support wall
18: first replacement piece
19: tablet discharge port
20: slit
21: partition member
21*a*: brush portion
22: intermediate gear
22*a*: first gear
22*b*: second gear
23: worm gear
24: stopper
25: shaft portion
26: spring
27: locking/receiving portion
28: guide groove
29: pin holding portion
30: second replacement piece
31: escape recess
32: bearing portion
33: driven gear
34: first carrying member
34*a*: roller
34*b*: round belt
35: carrying belt conveyor
36: container support portion
36*a*: support member
37: second carrying member
38: holding member
38*a*: vertical rail
39: opening/closing frame member
40: stop portion
41: third carrying member
42: horizontal movement member
43: ascent/descent member
44: container holding member
44*a*: holding member
44*b*: motor
44*c*: roller
44*d*: belt
44*e*: ball screw
45: horizontal slider
45*a*: arm sensor
45*b*: drive arm
45*c*: protrusion
45*d*: rod
46: horizontal rail
47: ascent/descent belt conveyor
48: count sensor
49: advance/retreat motor
50: rod (drive shaft)
51: lock pin
52: fourth carrying member
53: ascent/descent stand
54: rotating plate
54*a*: gear portion
55: slide guide
55*a*: rack
56: arm member
58*a*: arm
56*b*: support shaft
57: vertical rail
58: rotation motor
58*a*: drive gear
59: opening/closing motor
59*a*: pulley
59*b*: belt
60: slide motor
60*a*: pinion
61: extraction port
62: display
63: control device
64: standby portion
65: container holding member
66: support plate
67: guide arm
68: guide frame member
68*a*: guide member
68*b*: support shaft
69: both sides extending portion
70: back side extending portion
71: rotation member
71*a*: erect portion
71*b*: spring
72: pedestal portion
73: upper opening
74: first fixing potion
75: second fixing portion
76: guide portion
77: guide portion
78: inner edge portion

BEST MODE FOR CARRYING OUT THE INVENTION

In the following, an embodiment of the present invention will be described with reference to the accompanying drawings.

FIGS. 1 through 4 show a tablet filling device according to this embodiment. This tablet filling device is equipped with a container supply unit 1, a labeling unit 2, a tablet supply unit 3, a capping unit 4, a carrying member 5, and an extraction unit 6.

The container supply unit 1 is equipped with a plurality of buckets 8 arranged side by side in the lower portion of the front side of a device main body 7 (position along the surface to which a cassette is attached), with each bucket 8 accommodating tablet containers (which, in this example, are vials 9) of different sizes. Each bucket 8 can be opened on the front side of the device main body 7 so that vials 9 can be replenished. The vials 9 accommodated in each bucket 8 are lifted by a well-known lifter, and are conveyed to a first carrying member 34.

The labeling unit 2 serves to affix labels to the outer peripheral surfaces of the vials 9 carried, and may include a well-known one (see, for example, U.S. Pat. No. 5,798,020).

Figure 5:
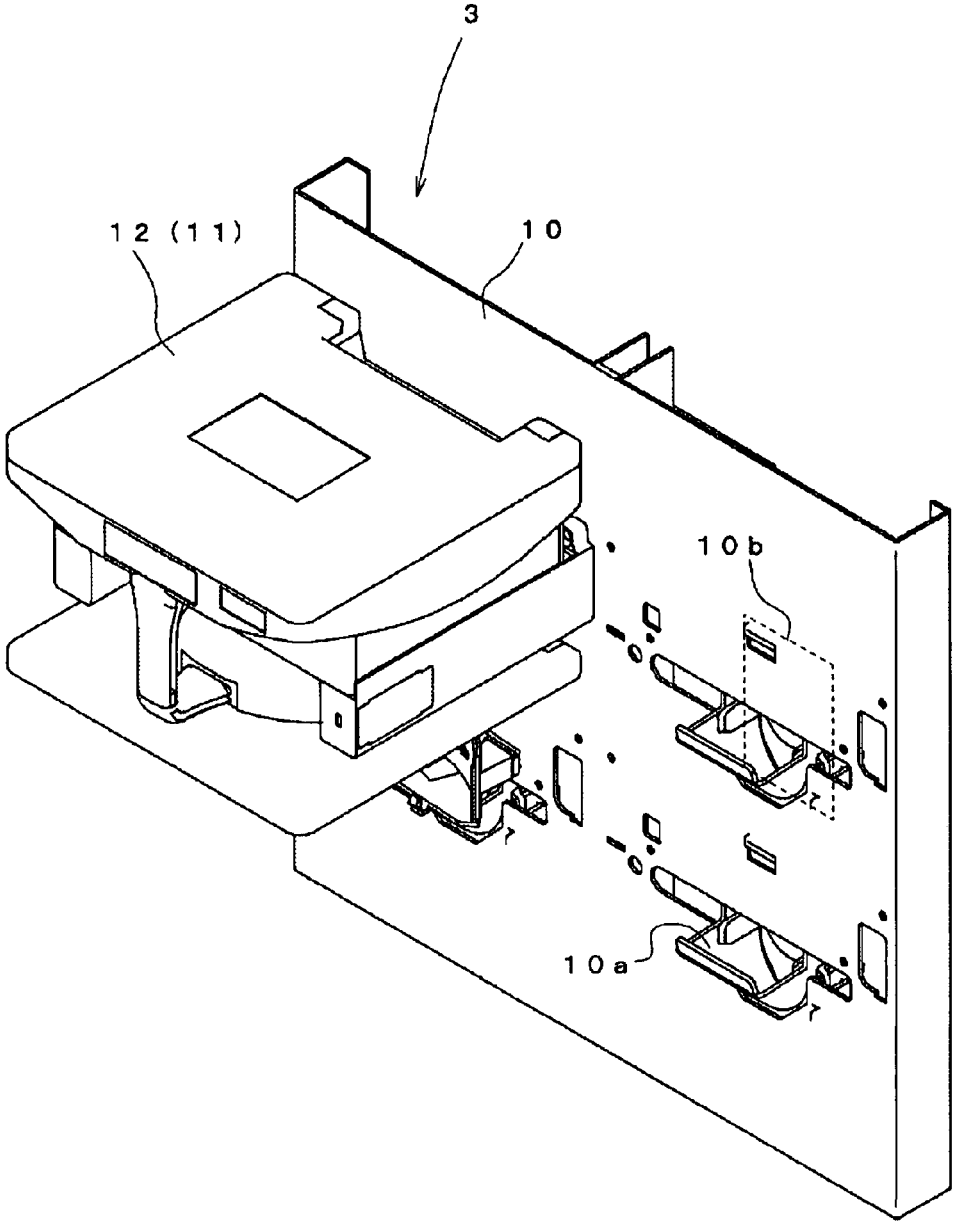
FIG. 5 is a perspective view of a part of the tablet filling unit of FIG. 1.

As shown in FIG. 5, the tablet supply unit 3 is equipped with a plurality of tablet feeders 11 fixed to a support panel 10. The tablet feeders 11 accommodate tablets of different kinds.

Figure 6:
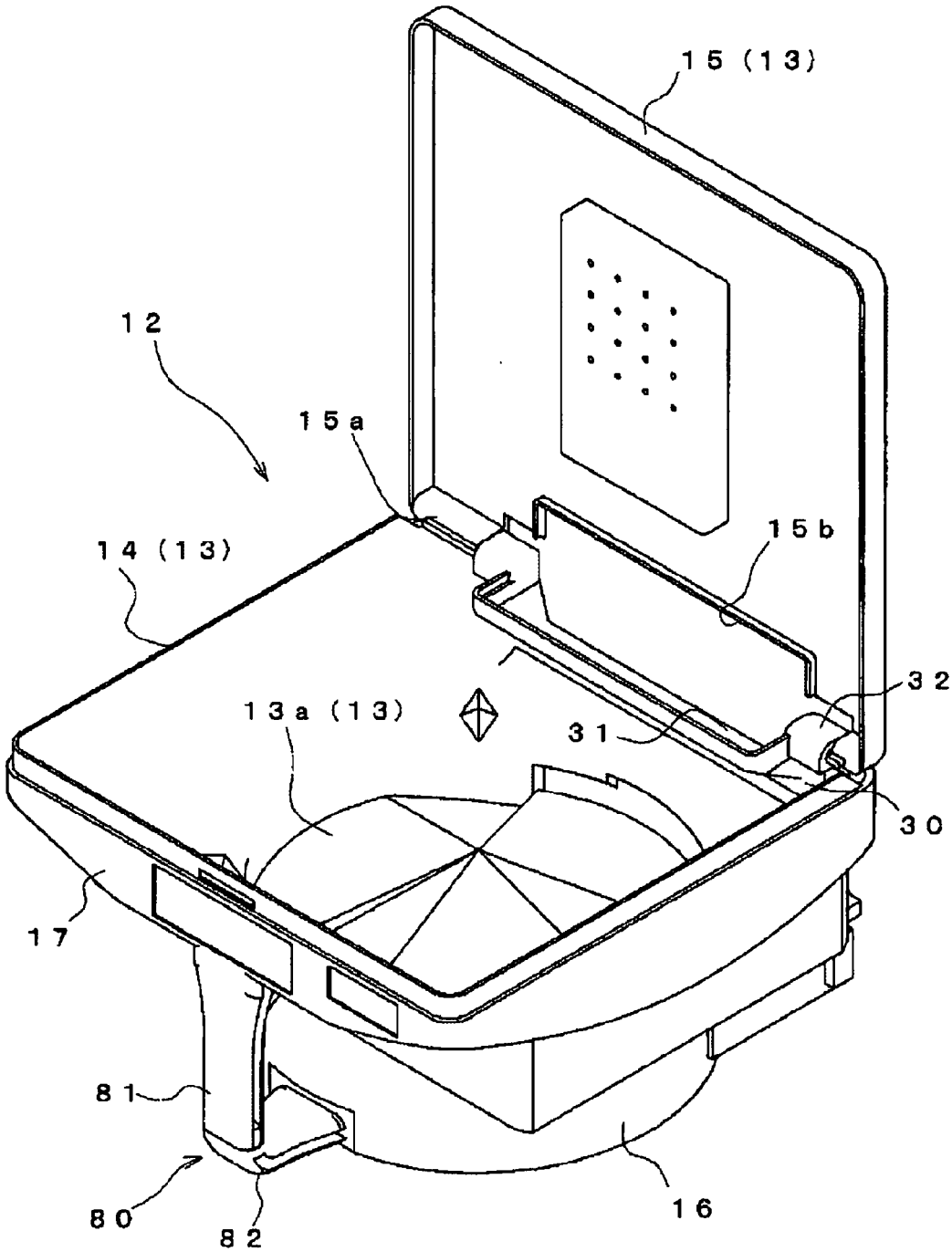
FIG. 6 is a perspective view of a tablet container of F*ig*. 5 with its cover member open.

As shown in FIG. 6, each tablet feeder 11 is formed of a tablet cassette 12 accommodating a rotor 13. Through rotation of the rotor 13, it is possible to dispense the accommodated tablets one by one.

Each tablet cassette 12 is formed of a cassette main body 14 equipped with a cover member 15 that can be opened and closed.

The cassette main body 14 is composed of a cylindrical rotor accommodating portion 16 and a rectangular barrel-shaped tablet accommodating portion 17 situated thereon. In the tablet accommodating portion 17, the upper surface (conical surface 13*a*) of the rotor 13 and the side wall form a space capable of accommodating tablets.

Figure 7:
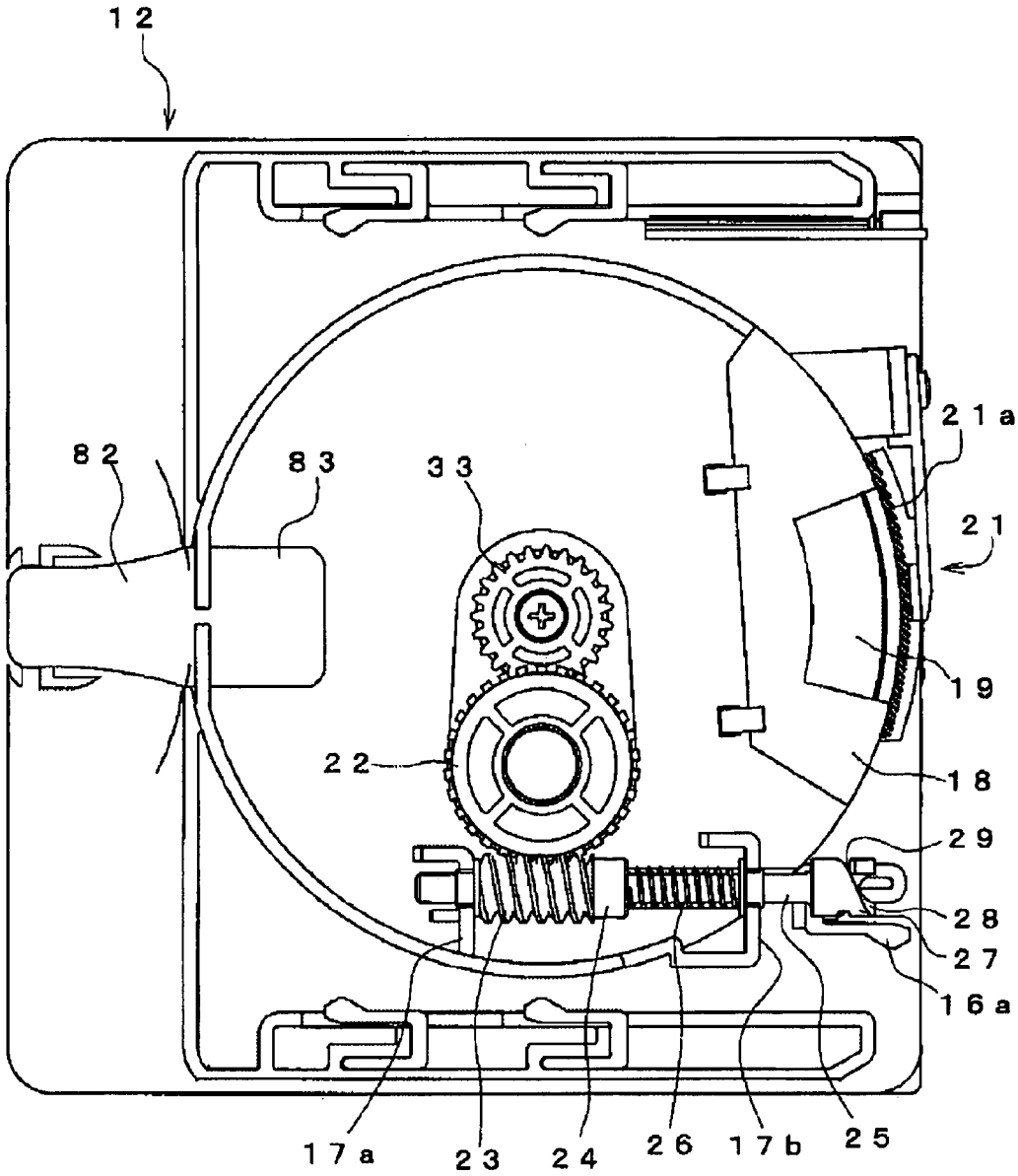
FIG. 7 is a bottom view of a tablet container shown in F*ig*. 6.
Figure 8:
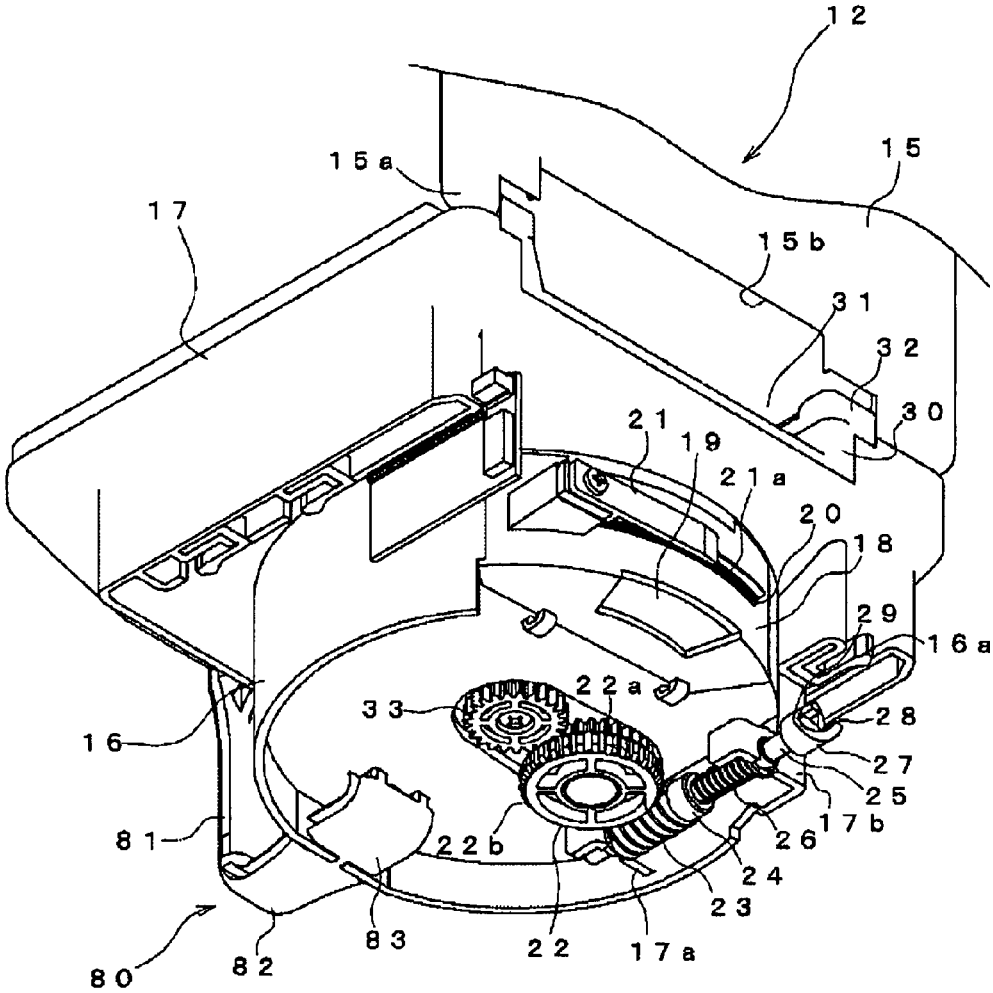
FIG. 8 is a perspective view, as seen from the bottom side, of the tablet container shown in FIG. 6.

As shown in FIGS. 7 and 8, a part of the back side of the rotor accommodating portion 16 is formed by a detachable first replacement piece 18. A tablet discharge port 19 and a slit 20 are formed in the first replacement piece 18. A partition member 21 is fixed in position in the vicinity of the slit 20, with a brush portion 21*a* thereof protruding into the rotor accommodating portion 16 through the slit 20. By forming the tablet discharge port 19 and the slit 20 by the replaceable first replacement piece 18, it is possible to adjust to different forms of the rotor 13 solely through replacement of the first replacement piece 18, and the remaining portion can be formed in a common structure.

At the center of the bottom surface of the rotor accommodating portion 16, there is formed a through-hole (not shown), and an intermediate gear 22 is rotatably mounted in the vicinity thereof. The intermediate gear 22 is composed of a first gear 22*a* and a second gear 22*b* arranged in the axial direction and integrated with each other.

Further, at the bottom surface of the rotor accommodating portion 16, there is mounted a worm gear 23 in mesh with the second gear 22*b* of the intermediate gear 22. That is, support walls 17*a*, 17*b* protrude at a predetermined interval from the bottom surface of the rotor accommodating portion 16 to rotatably support the worm gear 23. A stopper 24 is provided at one end of the worm gear 23, and a spring 26 is fitted onto a shaft portion 25 protruding therefrom. The spring 26 is situated between the stopper 24 and the support wall 17*b*, and urges the worm gear 23 toward the support wall 17*a* situated on the opposite side. As a result, the worm gear 23 is held in position, with its tooth surface held in press contact with the tooth surface of the second gear 22*b* of the intermediate gear 22. A locking/receiving portion 27 is formed at the forward end of the shaft portion 25. The locking/receiving portion 27 has a cylindrical outer peripheral wall in which a spiral guide groove 28 is formed at two opposing positions. Further, at the terminal end thereof, there is provided a pin holding portion 29 formed through peripheral cutting.

As shown in FIGS. 6 and 8, the upper portion of the back surface of the tablet accommodating portion 17 is formed by a detachable second replacement piece 30. The second replacement piece 30 is equipped with an escape recess 31, and bearing portions 32 are formed at both ends thereof. The second replacement piece 30 is provided with the escape recess 31 since, from the viewpoint of molding, it is difficult to form in the tablet cassette 12 an inwardly swollen inclined portion for forming the escape recess 31.

On the front side of the tablet containing portion 17, there is provided a grip 80 composed of third, fourth, and fifth replacement pieces 81, 82, and 83, respectively. By grasping the grip 80, it is possible to attach the tablet cassette 26 to the support panel 10 and draw it out.

In this way, the second, third, fourth, and fifth replacement pieces 30, 81, 82, and 83 are molded by separate processes, respectively, and can be attached to the tablet cassette 6 afterwards, whereby it is possible to suppress an increase in the mold cost, etc.

The cover member 15 is formed as a rectangular plate, and is equipped with a shaft portion 15*a* rotatably supported by the bearing portions 32. On the inner side of the shaft portion 25, there is formed a cutout portion 15*b* in correspondence with the escape recess 31. Owing to the escape recess 31 and the cutout portion 15*b*, interference with the discharge path for the tablet cassettes 12, arranged upwardly adjacent thereto, is avoided. As a result, it is possible to arrange the tablet cassettes 12 at high density in the vertical direction.

The rotor 13 is of a columnar configuration, and its upper surface is formed as the conical surface 13*a* protruding toward the center. An axially extending guide groove (not shown) is formed in the outer peripheral surface of the rotor 13, and tablets are accommodated in an aligned state therein, one on the upper side and one on the lower side. The tablets in the guide groove is vertically separated by the brush portion 21*a* of the partition member 21, and solely the one tablet on the lower side is dropped through the tablet discharge port 19. At the center of the lower surface of the rotor 13, there is integrally provided a rotation shaft, which extends through the through-hole formed in the bottom surface of the rotor accommodating portion 16, with a driven gear 33 being fixed to the protruding portion thereof. The driven gear 33 is in mesh with the first gear 22*a* of the intermediate gear 22. As a result, when the worm gear 23 is rotated, the driven gear 33 and the rotor 13 are rotated through the intermediate gear 22.

Although not shown in detail, in the capping unit 4, a cap supplied from the cap supply portion through a chute is supported by a support arm, and an upper opening 73 of the vial 9 downwardly carried by a third carrying member 41 described below is closed, the cap being rotated while pressed by the cap attachment portion to thereby effect capping.

The carrying member 5 is formed by first, second, third, and fourth carrying members 34, 37, 41, and 52, respectively.

Figure 3:
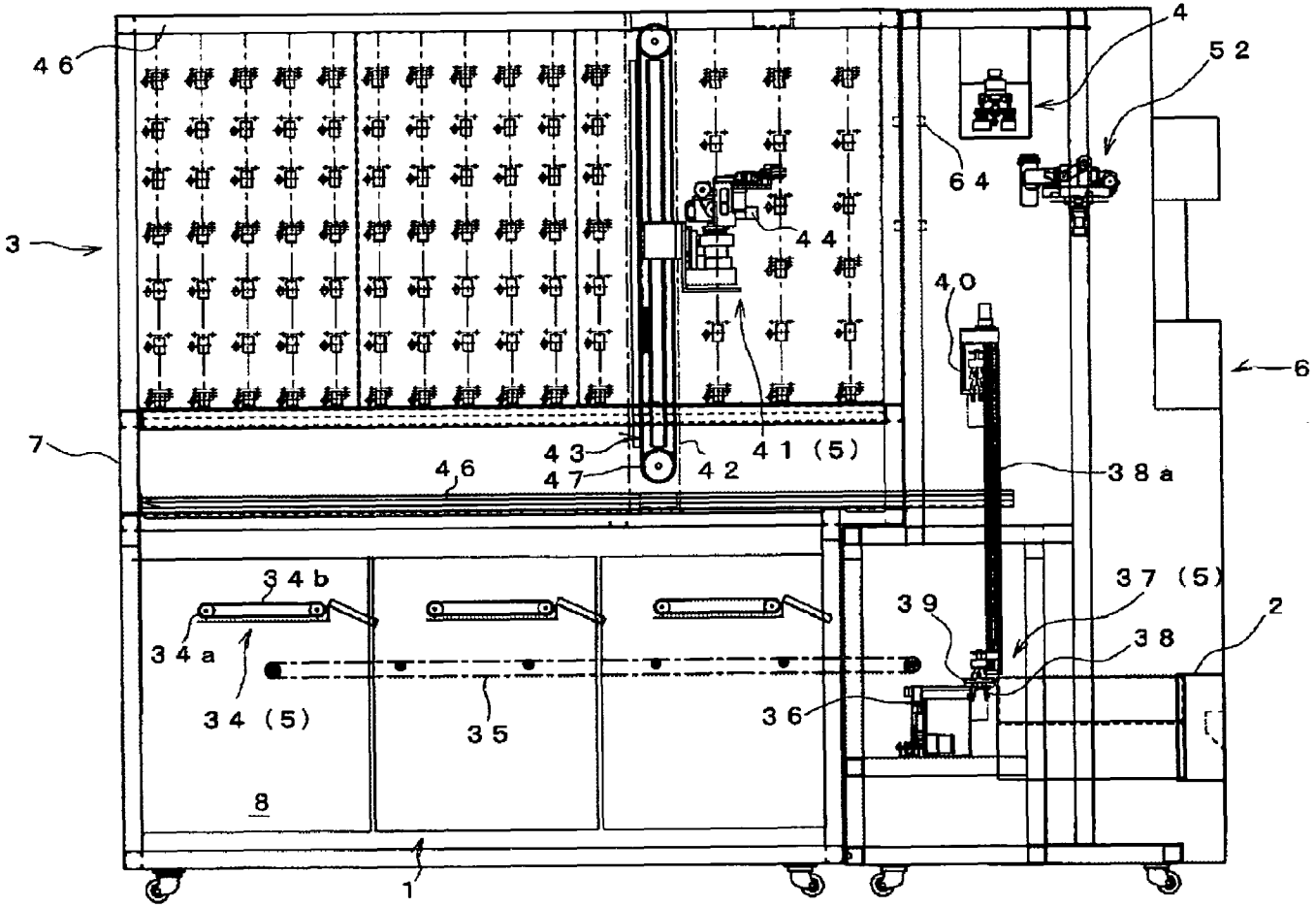
FIG. 3 is a schematic front sectional view of an inner mechanism of FIG. 1.

As shown in FIG. 3, each of the first carrying member 34 is composed of rollers 34*a* arranged at a predetermined interval and two round belts 34*b* stretched therebetween at a predetermined interval, and is arranged behind a lifter arranged on the back side of each bucket 8. The vial 9 to be extracted by the lifter is placed on the round belts 34*b*. By rotating the rollers 34*a* by a motor (not shown), the vial 9 placed on the round belts 34*b* is carried, and, further, can be transferred to the extraction unit 6 side by a carrying belt conveyor 35. At the destination of the carrying by the first carrying member 34, there is arranged a slidable container support portion 36 for vertically supporting the vial 9 according to its size such that its opening is directed upwardly. The container support portion 36 are composed of support members 36*a* protruding at predetermined intervals, and the distance between the adjacent support members 36*a* is set at a value allowing supporting of the flange portions of vials 9 of different sizes.

As shown in FIG. 3, the second carrying member 37 is equipped with a pair of holding members 38 for holding and upwardly moving the vial 9 supported by the container support portion 36. The holding members 38 ascends and descends on a vertical rail 38*a*, and are rotatable about a support shaft. The upper end portions of the holding members 38 are urged by a spring (not shown) so that the lower end portions thereof may be separated. Further, a rectangular opening/closing frame member 39 is provided around the lower ends of the holding members 38. The opening/closing frame member 39 is movable between a closed position at which the lower ends of the holding members 38 are brought close to each other against the urging force of the spring 26, and an open position at which they are held in press contact with the inner surface of the vial 9 to hold the same. The opening/closing frame member 39 is moved to the closed position by raising the holding members 38 and causing them to abut a stop portion 40 arranged above the opening/closing frame member 39.

In the second carrying member 37, the holding members 38 are lowered with their lower ends brought close to each other by the opening/closing frame member 39; at the point of time when the holding members 38 enter the vial 9, the opening/closing frame member 39 abut the upper portion of the vial 9. As a result, when the holding members 38 further descend, the guide by the opening/closing frame member 39 is canceled, and the holding members 38 are spread due to the urging force of the spring to thereby hold the vial 9. When the holding members 38 ascends while holding the vial 9, the opening/closing frame member 39 abuts the stop portion 40, and the holding members 38 are forcibly placed in the closed state, with the holding state for the vial 9 being canceled.

Figure 9:
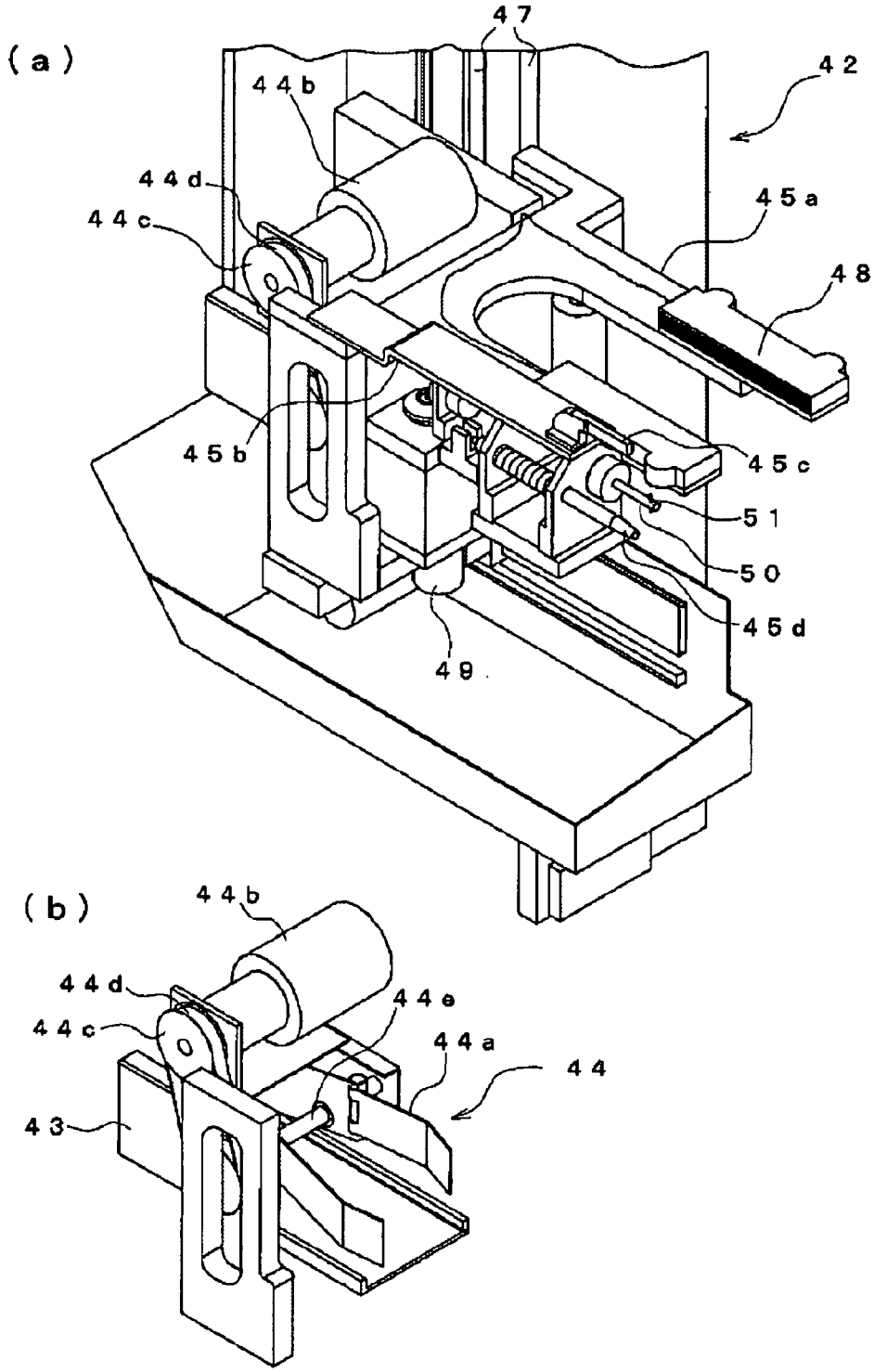
FIG. 9 includes portion (a) showing a main portion perspective view of a third carrying member shown in FIG. 1, and portion (b) showing a perspective view of a container holding member with the arm sensor of portion (a) removed.

As shown in FIG. 3, and in more detail in FIG. 9, the third carrying member 41 is composed of a horizontal movement member 42, an ascent/descent member 43, and a container holding member 44, and carries the tablet cassette 12 mainly between the tablet supply unit 3 and the capping unit 4.

The horizontal movement member 42 is capable of horizontally reciprocating along upper and lower horizontal rails 46.

The ascent/descent member 43 is capable of vertically reciprocating an ascent/descent belt conveyor 47 provided on the horizontal movement member 42 along the horizontal movement member 42 by driving a motor (not shown).

The container holding member 44 is mounted onto the ascent/descent member 43, and can hold the vial 9 by means of a pair of holding members 44*a* adapted to be opened and closed through a roller 44*c*, a belt 44*d*, and a ball screw 44*e* by driving a motor 44*b* (see FIG. 9(*a*)). The position at which the vial 9 is held by the holding members 44*a* is substantially in the same axis regardless of the difference in the outer diameter dimension of the vial 9. On one holding member 44*a*, there is provided a piezoelectric element (not shown) adapted to be oscillated by a fluctuating voltage applied. While the vial 9 is held by the holding members 44*a*, the piezoelectric element is oscillated by applied voltage, placing the tablets filling the vial 9 in a high-density state free from clearances. Above the container holding member 44, there are provided a U-shaped arm sensor 45*a* and a drive arm 45*b*. A count sensor 48 is provided at the forward end of the arm sensor 45*a*. The count sensor 48 is composed of a light emitting element and a light receiving element. An infrared laser beam is intercepted by a tablet passing it, whereby it is possible to detect a tablet discharged from the tablet feeder 11 and supplied to the vial 9. Then, the number of tablets supplied to the vial 9 is counted by a control device 63 described below based on signals from the count sensor 48. The drive arm 45*b* is provided with a rod 50 capable of normal and reverse rotation through driving of an advance/retreat motor 49. At the forward end of the rod 50, from two symmetrical axial positions thereof orthogonal to the direction in which the vial 9 is supplied, there protrude lock pins 51 to be engaged with and disengaged from the locking/receiving portion 27 of the worm gear 23 provided in the tablet feeder 11. Further, from the drive arm 45*b*, there protrude a protrusion 45*c* to be engaged with an engagement portion 16*a* formed on the back surface of the rotor accommodating portion 16 of the tablet cassette 12, and a rod 45*d* for pushing open a cover 10*b* closing a tablet outlet 10*a* of the support panel 10 of the tablet cassette 12.

Figure 10:
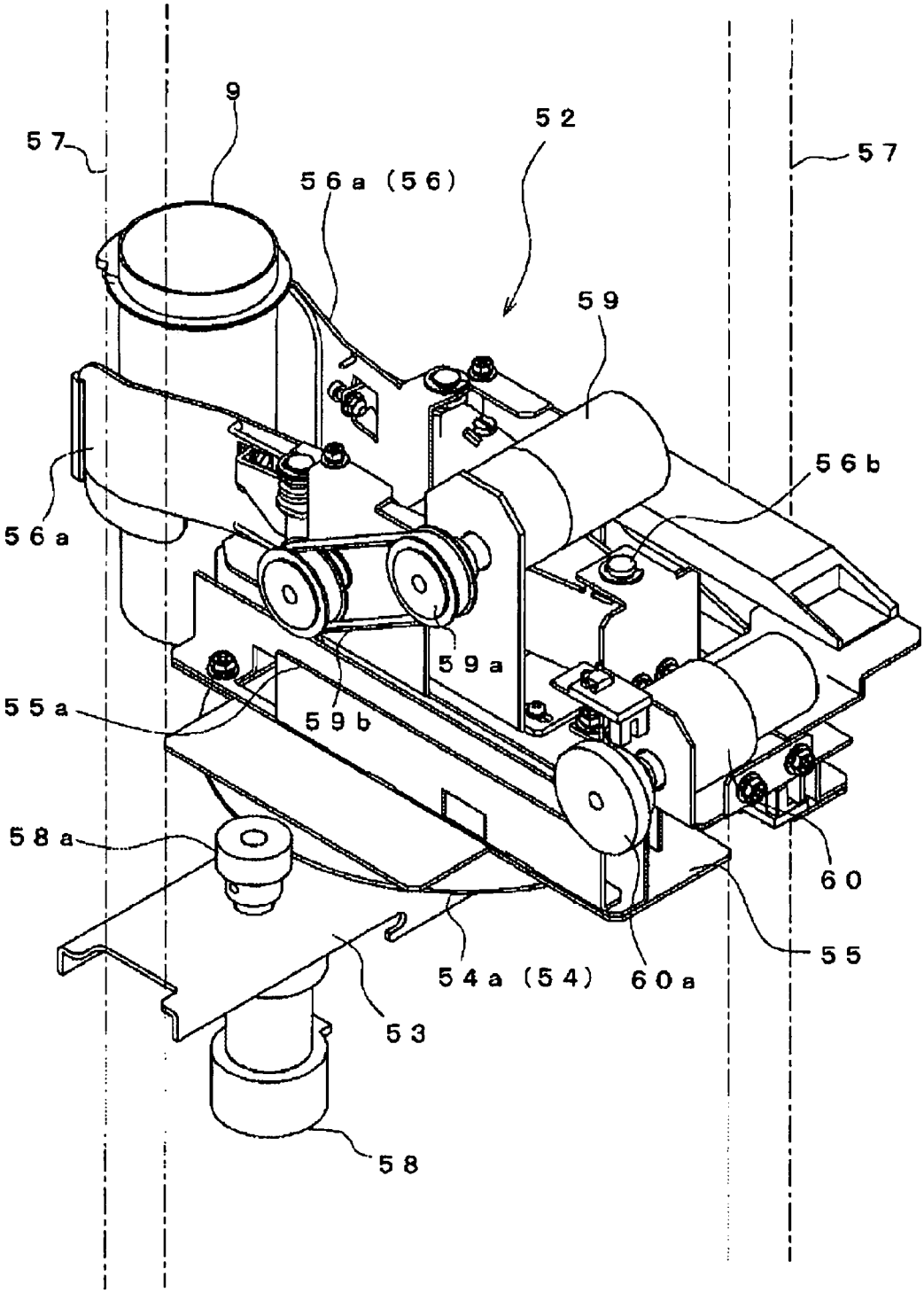
FIG. 10 is a main portion perspective view of a fourth carrying member shown in FIG. 1.

As shown in FIG. 3 and, in more detail in FIG. 10, the fourth carrying member 52 includes an ascent/descent stand 53 and an arm member 56 provided thereon through the intermediation of a rotating plate 54 and a slide guide 55, and serves to carry the vial 9 mainly between the extraction unit 6 and the capping unit 4.

Through driving of a motor (not shown), the ascent/descent stand 53 ascends and descends along vertical rails 57 arranged at a predetermined interval. The rotating plate 54 is rotatably provided on the ascent/descent stand 53, and has a gear portion 54*a* in the outer periphery thereof. The gear portion 54*a* is in mesh with a drive gear 58*a*. The drive gear 58*a* is fixed to the rotation shaft of a rotation motor 58 provided on the ascent/descent stand 53. As a result, when the drive motor 58 is driven, the rotating plate 54 makes normal or reverse rotation through the drive gear 58*a* and the gear portion 54*a*. The slide guide 55 is mounted onto the rotating plate 54, and has a rack 55*a* at the upper edge of the side plate portion thereof. The arm member 56 is equipped with a pair of arms 56*a*, an opening/closing motor 59, and a slide motor 60, and is slidably supported on the slide guide 55. The arm 56*a* is provided so as to be rotatable about a support shaft 56*b*, and is capable of holding the vial 9 at the forward end portion thereof. The position at which the vial 9 is held by the arms 56*a* is substantially in the same axis regardless of a difference in the outer diameter dimension of the vial 9. The opening/closing motor 59 rotates a screw shaft (not shown) through a pulley 59*a* and a belt 59*b* to open/close the arms 56*a*. The slide motor 60 has on the rotation shaft thereof a pinion 60*a* engaged with the above-mentioned rack, and reciprocates the arm member 56 with respect to the slide guide 55 through normal or verse rotation. The reciprocating range for the arm member 56 is restricted by the control device 63, which drive-controls the slide motor 60 based on detection signals from a sensor (not shown).

Figure 2:
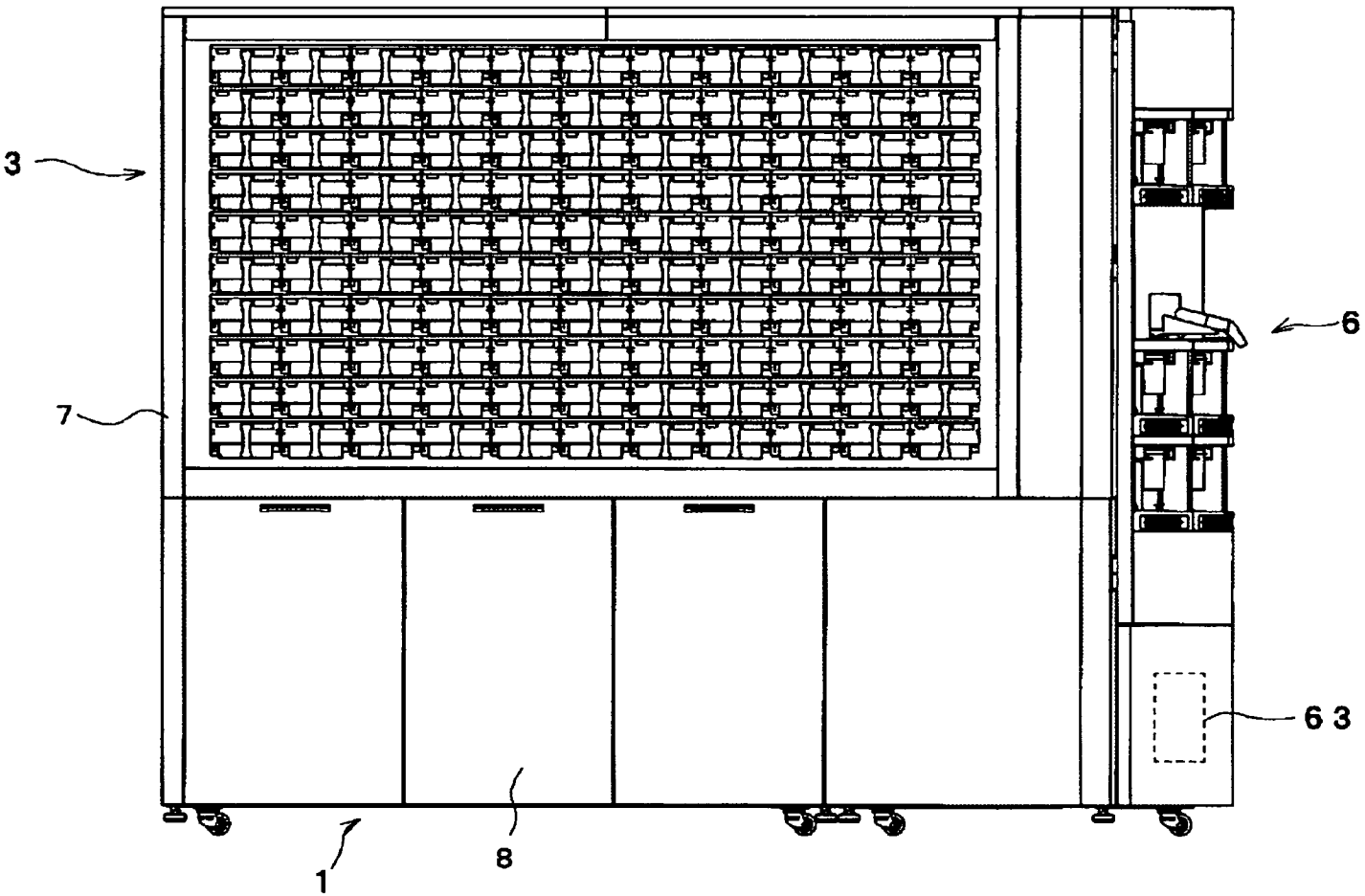
FIG. 2 is a front view of FIG. 1.

As shown in FIGS. 1 and 2, the extraction unit 6 is equipped with a plurality of extraction ports 61, and has at its center a display 62, with the control device 63 being contained in the lower portion thereof.

Figure 4:
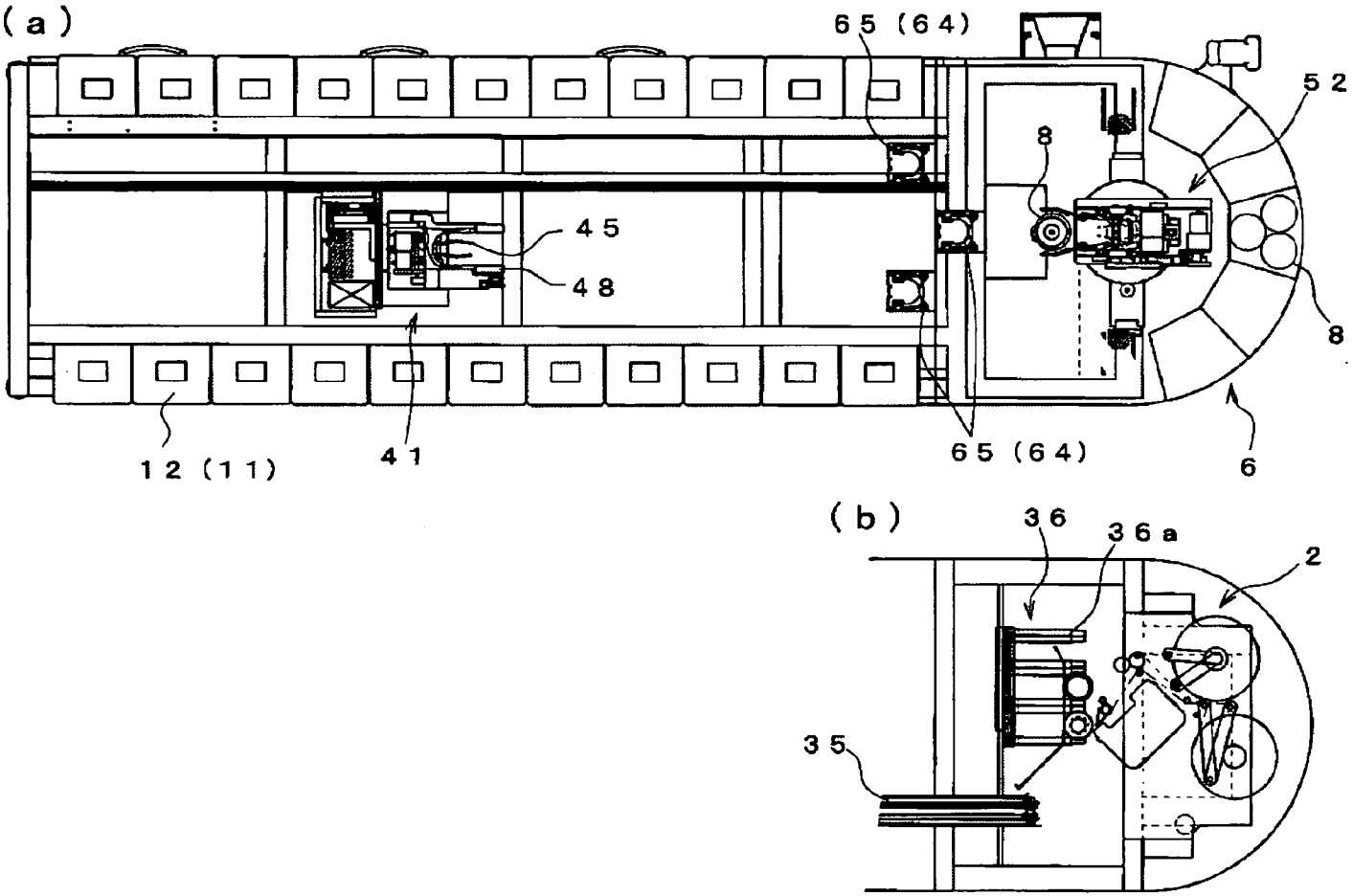
FIG. 4 includes portion (a) showing a schematic plan sectional view of the inner mechanism of FIG. 1, and portion (b) showing a partial sectional view thereof.
Figure 11A:
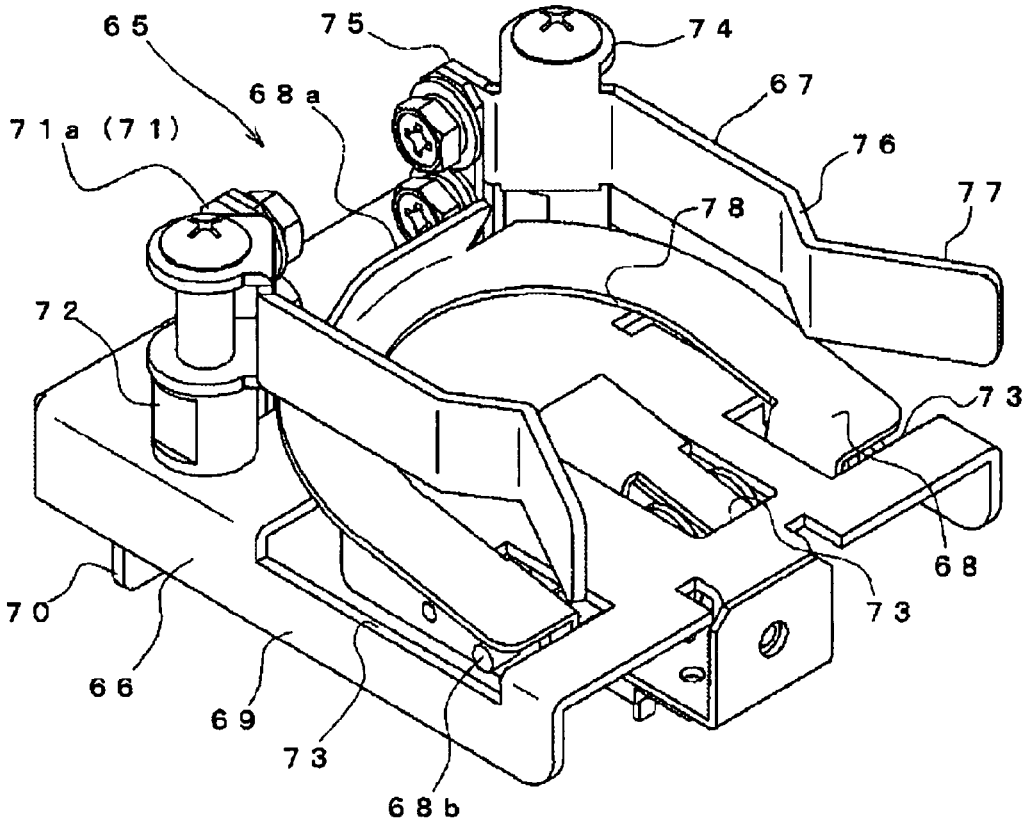
FIG. 11A is a perspective view of the container holding member shown in FIG. 4.
Figure 11B:
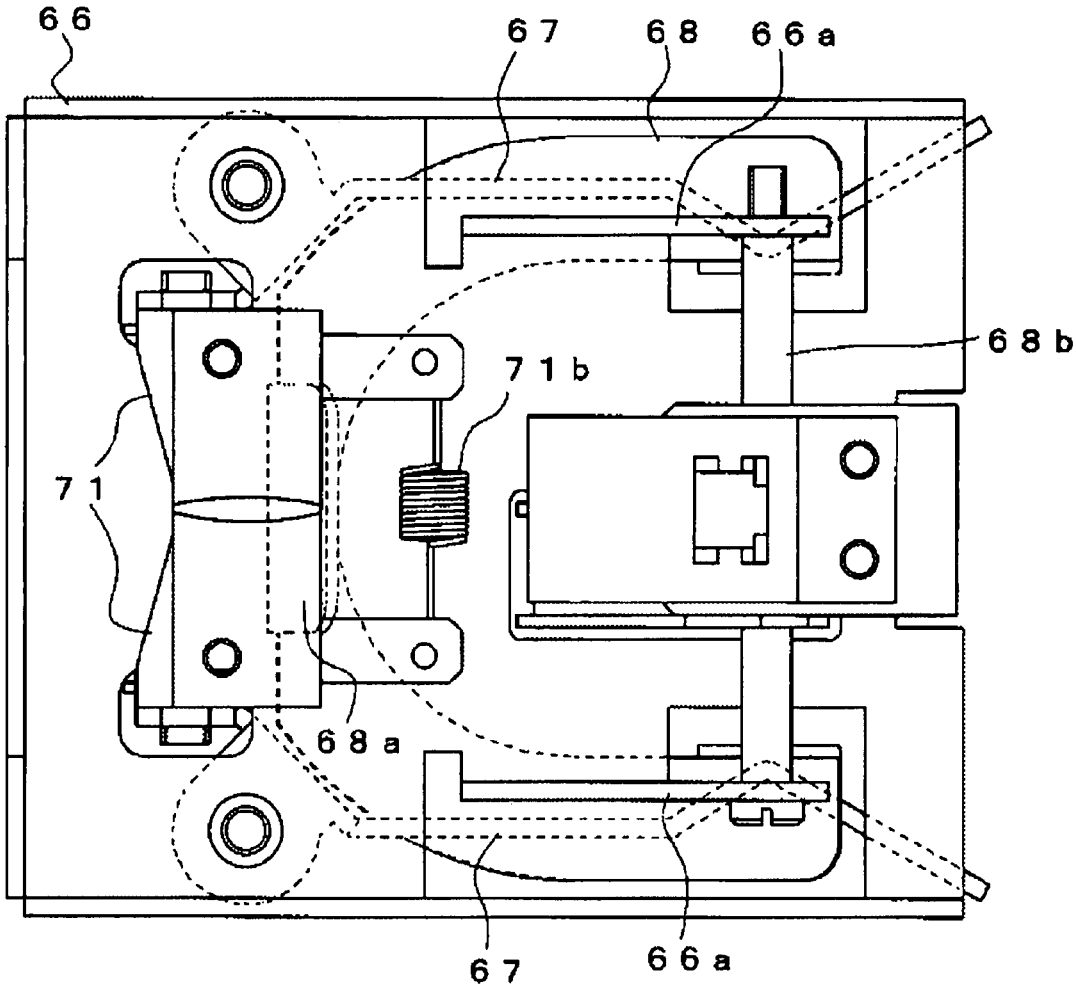
FIG. 11B is a bottom view of the container holding member shown in FIG. 11A.
Figure 12:
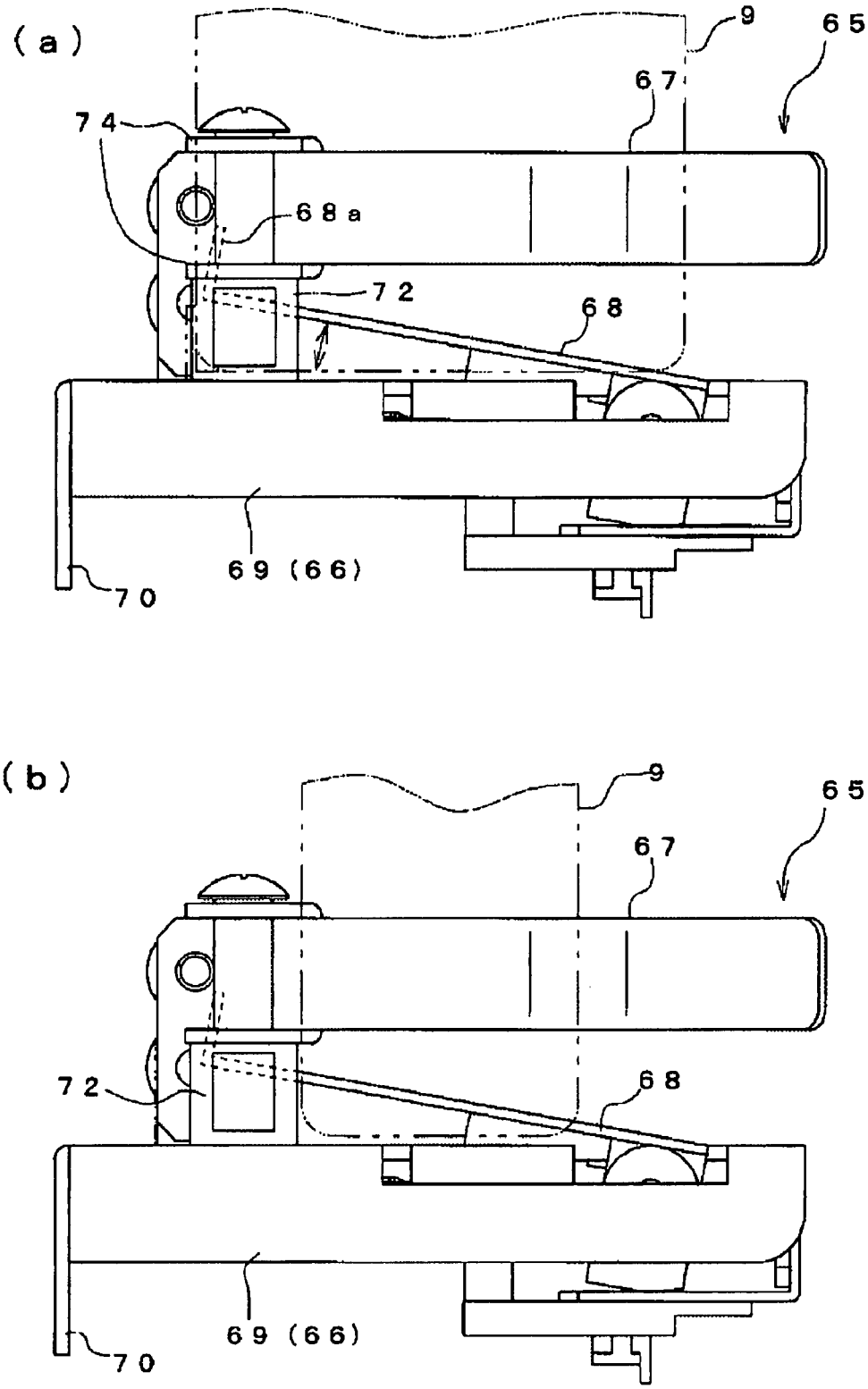
FIG. 12 includes portion (a) showing a front view of FIGS. 11 in which how a large diameter vial is held, and portion (b) showing how a small diameter vial is held.

As shown in FIGS. 3 and 4, a standby portion 64 is provided between the third carrying member 41 and the fourth carrying member 52. The standby portion 64 is formed by container holding members 65 provided at one delivery position and five standby positions. As shown in FIGS. 11 and 12, each of the container holding member 65 has a pair of guide arms 67 and a guide frame member 68 on a support plate 66.

The support plate 66 has, on both side edge portions and the back edge portion thereof, extending portions 69, 70 bent downwardly at right angles. The extending portions 69 on both sides serve to form a space for arranging a spring, etc. described below on the lower side of the support plate 66. The back side extending portion 70 is used for fixation by screws to the device main body 7. The openings 73 are formed on both sides and in the middle of the front side portion of the plate.

The guide arms 67 have, at one end thereof, first fixing potions 74 bent in an orthogonal direction and opposed to each other at a predetermined interval, and second fixing portions 75 extending further from between the first fixing portions 74. The first fixing portions 74 are fixed by screws to pedestal portions 72 rotatably provided on the support plate 66. The second fixing portions 75 are fixed by screws to one ends of rotation members 71 rotatably mounted onto the lower surface side of the support plate 66 in correspondence with the guide arms 67, that is, fixed by screws to erect portions 71*a* protruding on the upper surface side of the support plate 66. The other end portions of the rotation members 71 are connected by a spring 71*b* and are urged toward each other. As a result, the other end portions of the guide arms 67 are urged toward each other. The guide arms 67 are bent toward each other such that their other end portions abut the outer peripheral surface of the vial 9, forming a guide portion 76 for guiding a large diameter vial 9. Further, the forward end portion of the guide portion 76 gradually expands toward the forward end, forming a guide portion 77 for guiding the vial 9 carried by the third carrying member 41.

The guide frame member 68 is a substantially U-shaped plate-like member, and has a guide member 68*a* protruding from the middle portion thereof, with its both ends being rotatably supported by a support shaft 68*b*. The support shaft 68*b* is supported by protrusions 66*a* provided at a predetermined interval on the bottom surface of the support plate 66. Due to the urging force of a spring (not shown) provided on the support shaft 68*b*, the guide frame member 68 is inclined such that the guide member 68*a* side is situated on the upper side above the support plate 66. With the guide frame member 68 held in contact with the support plate 66, the guide member 68*a* guides the outer peripheral surface of a first vial 9 of a large outer diameter dimension together with the guide arms 67. The guide arms 67 and the guide frame member 68 form a first holding part. An inner edge portion 78 of the guide frame member 68 is formed in a dimension allowing guiding of a second vial 9 whose diameter is smaller than that of the first vial 9, and forms a second holding part. In both a case where the large diameter vial 9 is held by the first holding part and a case where the small diameter vial 9 is held by the second holding part, the vial 9 is situated in the same axis.

The standby portion 64 is used to temporarily keep on standby the vial 9 carried by the third carrying member 41 before carrying the vial 9 to the capping unit 4 by the fourth carrying member 52. When being already on standby at the delivery position, a vial 9 is kept on standby while held by the container holding member 65 at the standby position.

The control device 63 drive-controls the container supply unit 1, the labeling unit 2, the tablet supply unit 3, the capping unit 4, the carrying member 5, and the extraction unit 6 based on prescription data (what is set forth on the prescription by the doctor, data on the patient, etc.) input from a host computer or the like.

Figure 13:
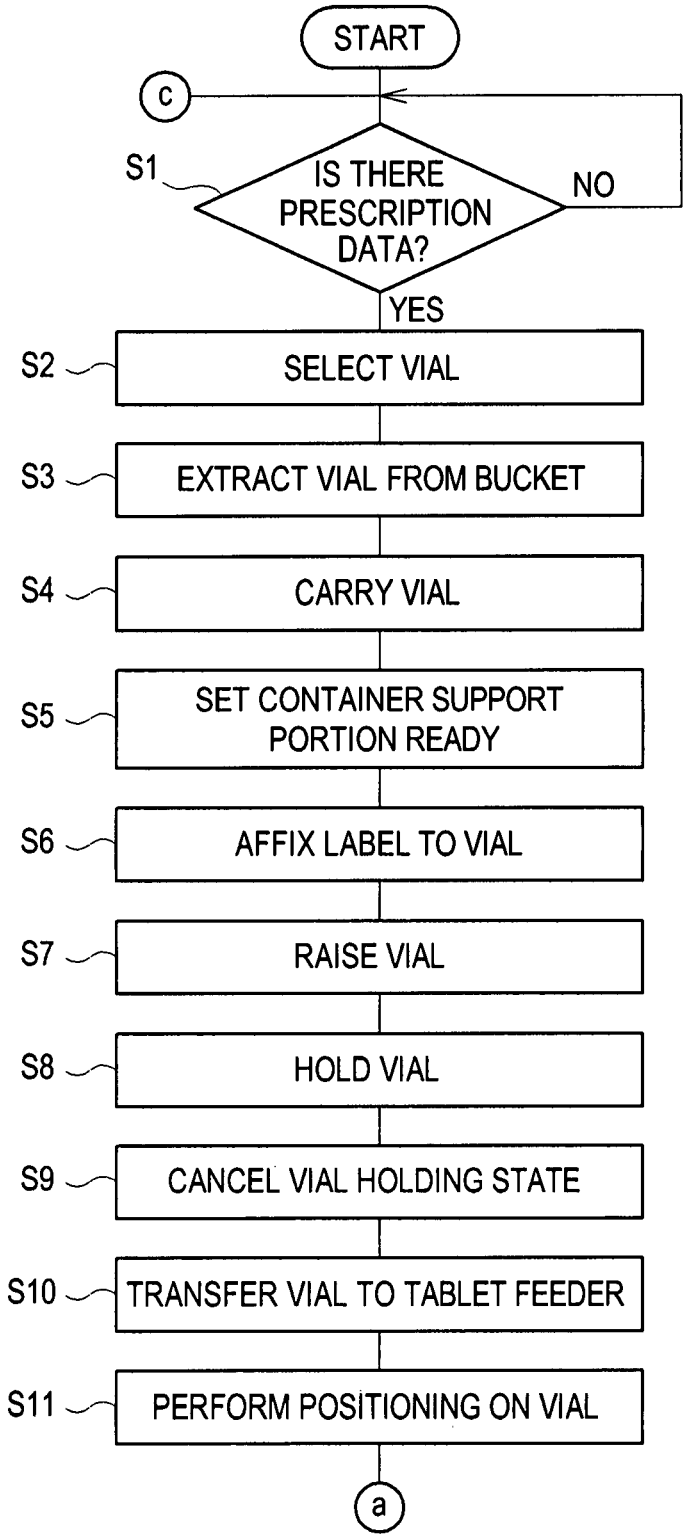
FIG. 13 is a flowchart showing the operation of the tablet filling device of this embodiment.
Figure 14:
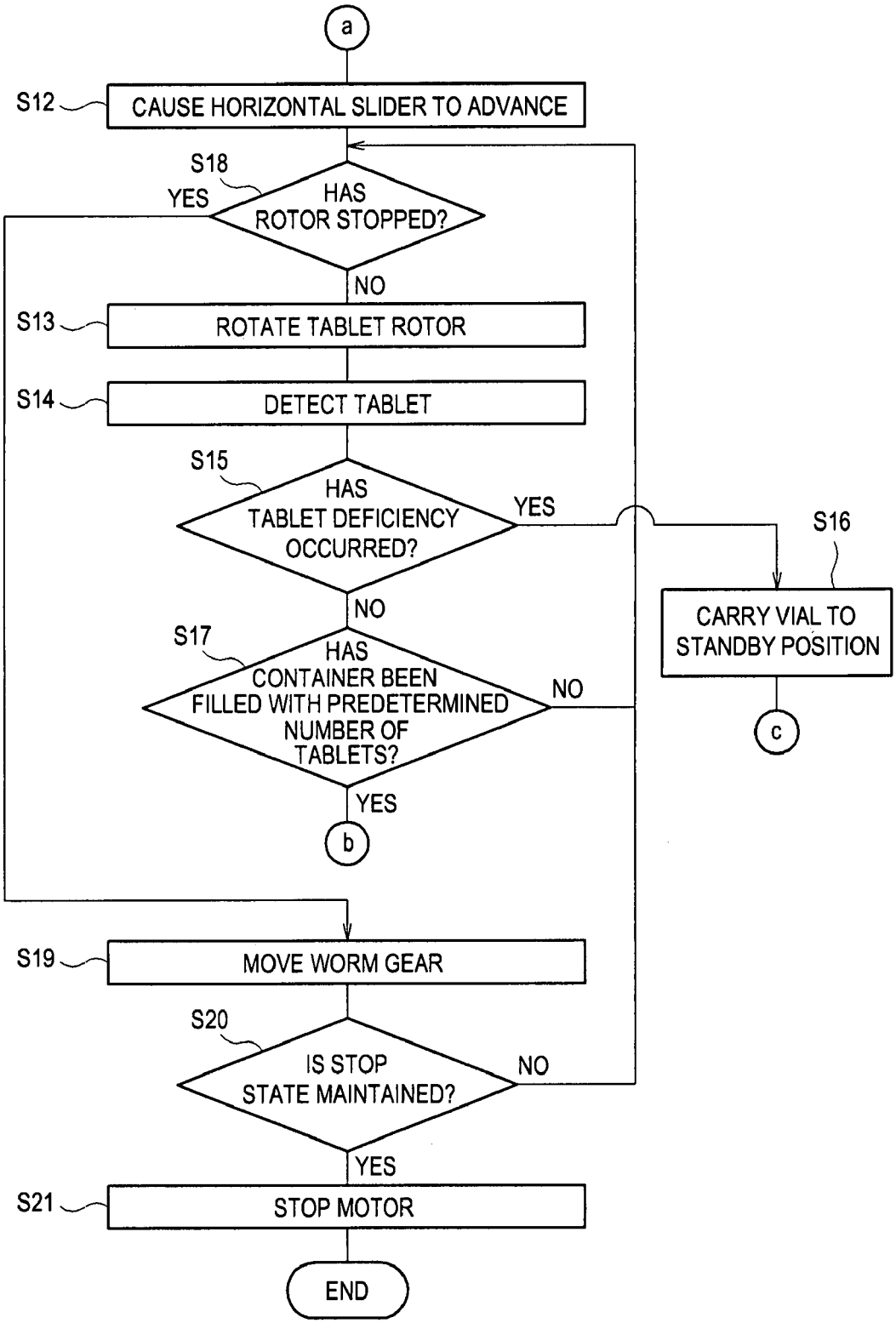
FIG. 14 is a flowchart showing the operation of the tablet filling device of this embodiment.
Figure 15:
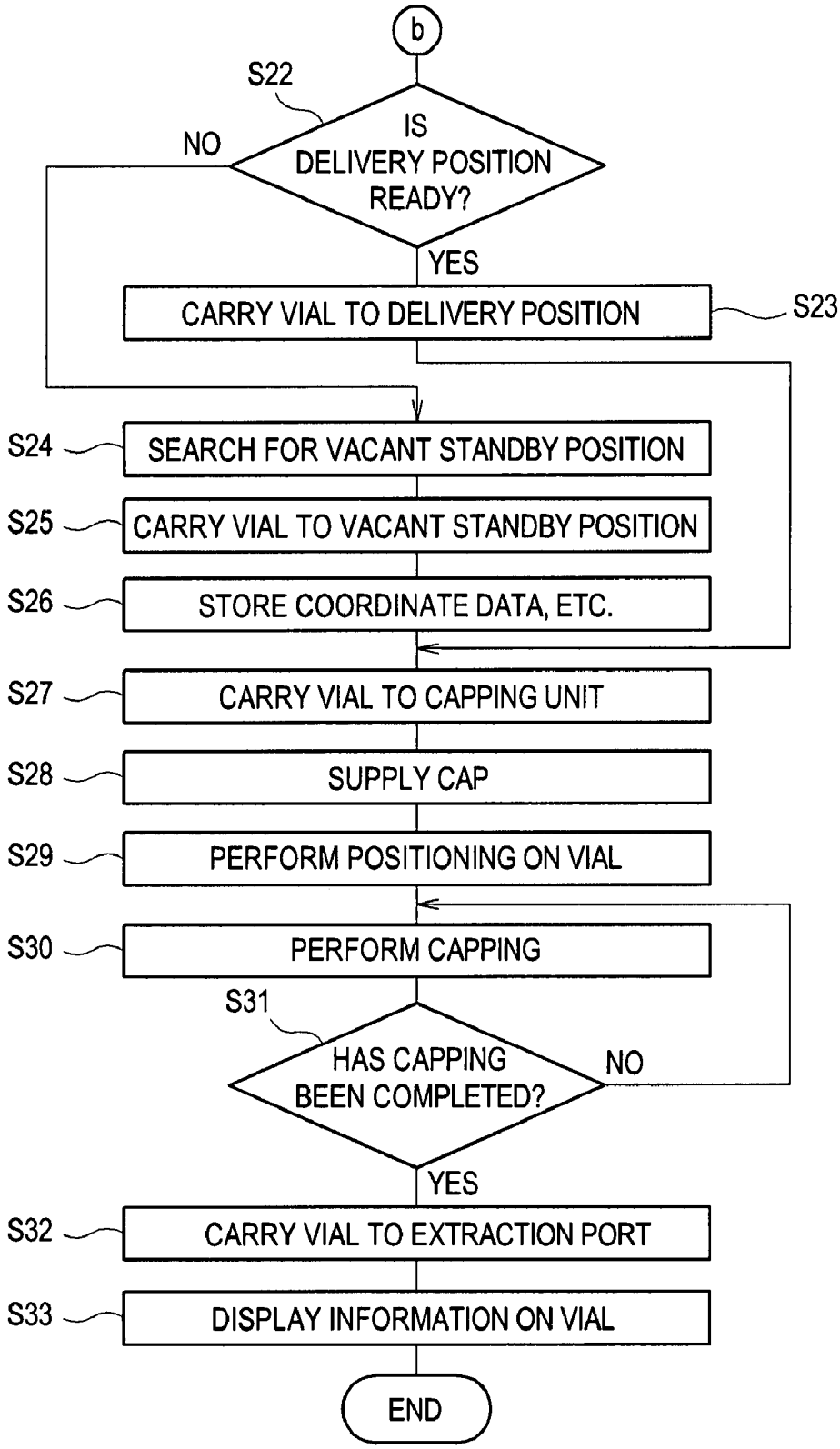
FIG. 15 is a flowchart showing the operation of the tablet filling device of this embodiment.

Next, the operation of the tablet filling device, constructed as described above, will be illustrated with reference to the flowcharts of FIGS. 13 through 15.

When prescription data is input from the host computer or the like (Step S1), a suitable vial 9 is selected taking into consideration the size and amount of the corresponding tablets based on the prescription data (Step S2). Then, the selected vial 9 is carried from the bucket 8 (Step S3). That is, the lifter is driven to carry the vial 9 to the first carrying member 34.

In the first carrying member 34, the vial 9 placed in a horizontal position on the round belts 34*b* by the lifter is carried toward the extraction unit 6 (Step S4). Then, the container support portion 36 is slid and kept ready so that the carried vial 9 can be received (Step S5). As a result, the vial 9 is supported in a vertical position at the container support portion 36 so as to be open on the upper side. Subsequently, the container support portion 36 is slid, and a label with a predetermined print is affixed to the outer peripheral surface of the vial 9 by the labeling unit 2 (Step S6). Further, the second carrying member 37 is driven, and the vial 9 is raised while held by the holding members 38 (Step S7).

Here, the third carrying member 41 is driven, and the vial 9 raised by the second carrying member 37 is held (Step S8). At this time, in the second carrying member 37, the holding members 38 are moved upwards, and the holding state for the vial 9 is canceled by forcibly bringing the lower ends of the holding members 38 close to each other by the guide frame member 68 (Step S9). The third carrying member 41 transfers the held vial 9 to the tablet feeder 11 containing the corresponding medicine based on the prescription data (Step S10). Then, the vial 9 is placed at a position where it is possible to collect tablets dropping from the tablet discharge port 19 of the tablet feeder 11 (Step S11).

Subsequently, the advancing/retreating motor 49 is driven to cause a horizontal slider 45 to advance (Step S12). As a result, the rod 45*d* advances to open the cover 10*b*, and the protrusion 45*c* is engaged with the engagement portion 16*a*. At this time, the rod 50 also advances, and the lock pins 51 thereof are locked to the locking/receiving portion 27 formed on the worm gear 23 of the tablet feeder 11. The guide groove 28 is formed in a spiral configuration, so the lock pins 51 smoothly enter the guide groove 28, and undergoes positioning at the locking/receiving portion 27. Here, the rod 50 is rotated, and the rotor 13 is rotated via the worm gear 23, the intermediate gear 22, and the driven gear 33 (Step S13). As a result, the tablet situated on the lower side, which is separated in the groove of the rotor 13 by the brush portion 21*a* of the partition member 21, drops through the tablet discharge port 19. The dropping tablet is detected by the count sensor 48 (Step S14), and, based on the detection signal, a determination is made as to whether the vial 9 has been filled with a predetermined number of tablets or not (Step S17). However, when no detection signal is output from the count sensor 48 although the filling is halfway through (Step S15), it is determined that there is no more tablet in the tablet cassette 12 (deficiency), and the vial 9 is temporarily carried to the standby position (Step S16). Then, the procedure returns to Step S1, and the above-mentioned processing is continued on the next vial 9. As a result, even when tablet deficiency occurs halfway through the tablet filling operation, it is possible to continue filling operation on the next vial 9, and there is no fear of the operation being suspended. Thus, it is possible to perform an efficient processing.

It may occur, during the operation of filling the vial 9 with tablets from the tablet feeder 11, that the rotation of the rotor 13 stops due to clogging with a tablet, etc. In this case, a force is applied to the tablet as a result, for example, of being caught between the inner edge of the tablet discharge port 19 and the groove of the rotor 13. It should be noted, however, that the worm gear 23 is axially slidable while urged by the spring 26. Thus, the worm gear 23 moves before the tablet has suffered damage, mitigating the force applied to the tablet. Further, at this time, an excess current flows through the motor, and the stopping of the rotation of the rotor 13 is detected. Thus, based on this detection signal (Step S18), the horizontal slider 45 is moved to cause the rod 50 to retreat, whereby the worm gear 23 is moved against the urging force of the spring 26 (Step S19). As a result, the driven gear 33 and the rotor 13 make reverse rotation via the intermediate gear 22 according to the displacement of the worm gear 23, thereby eliminating the clogging with the tablet. Thus, it is possible to cause the rotor 13 to make normal rotation, and to resume the supply of tablets. However, in a case where the stop state is maintained even when the rotor 13 is caused to make reverse rotation through movement of the worm gear 23 (Step S20), an error is reported to stop the motor (Step S21). When the stop state of the rotor 13 is maintained, the reverse rotation of the rotor 13 through movement of the worm gear 23 may be repeated a plurality of times.

At the delivery position, it is confirmed that no vial 9 is on standby (Step S22). When no vial 9 is on standby at the delivery position, the present vial 9 is carried to the container holding member 65 of the delivery position (Step S23). At the container holding member 65 of the delivery position, the vial 9 is brought in from the forward end side of the guide arm 67 (the direction of the arrow in FIG. 11). As shown in FIG. 9(*a*), in the case of a large diameter vial 9, the outer peripheral surface thereof abuts the guide portions 77 of the guide arms 67 and pushes them apart from each other. As a result, the vial 9 is guided by the guide portions 76 of the guide arms 67 and the guide members 68*a* of the guide frame member 68. At this time, the guide frame member 68 is held in contact with the support plate 66 by the weight of the vial 9. In the case of a small diameter vial 9, the outer peripheral surface thereof is guided by the inner edge portion 78 of the guide frame member 68 inclined above the support plate 66 by the urging force of the spring. At this time, the outer peripheral surface of the vial 9 is also held by the guide arms 67. For the vial 9 of either size, the guide position is situated in the same axis. Thus, the position where the vial 9 is held by the holding members 44*a* of the third carrying member 41, or the position where the vial 9 is held by the arms 56*a* of the fourth carrying member 52, can always be the same regardless of the outer diameter dimension of the vial 9. Thus, the positional data indicating the degree to which the arms 56*a* are to be moved is the same, thereby simplifying the construction and control program and making it possible to smoothly carry the vial 9.

When the preceding vial 9 is already on standby at the delivery position, a vacant container holding member 65 is searched for from among the standby positions (Step S24), and the vial 9 is carried to the vacant container holding member 65 determined to be vacant (Step S25). In this case, coordinate data on the standby position is stored in the storage portion of the control device 63, so the size of the vial 9 conveyed and the kind of tablets to be accommodated in the vial 9 are stored in relation to the coordinate data (Step S26). As a result, when the capping at the capping unit 4 is enabled, it is possible to carry the corresponding vial 9 to the capping unit 4 by the third carrying member 41 based on the stored data.

When the vial 9 is thus carried to the delivery position or the standby position, the fourth carrying member 52 is driven, and the vial 9 is carried to the capping unit 4 while held by the arms 56*a* (Step S27). A cap is supplied via a chute (Step S28), and this cap is situated so as to cover the upper opening 73 of the vial 9 carried (Step S29). Then, the cap attachment portion is driven to cap the vial 9 (Step S30). When the capping is completed (Step S31), the vial 9 held by the arms 56*a* is carried by the fourth carrying member 52 to an extraction port 61 (Step S32). At the extraction port 61, information on the vial 9 carried (e.g., the name of the tablets accommodated therein) is indicated on the display 62 (Step S33). Accordingly, the operator can understand at a glance the prescription data on the tablets accommodated in the vial 9 extracted.

In the container holding member 65 at each position, the size of the vial 9 that can be held may differ. In this case, the positions, such as the delivery position and standby positions, and the sizes of the vials 9 that can be held by the standby portions 64 at those positions are stored in the storage portion of the control device 63. The combination of vials that can be guided by the first holding part and the second holding part can be arbitrarily set.

Further, the container holding member 65 at each position may be provided with a sensor for detecting the vial 9. For example, when the vial 9 held by the container holding member 65 is toppled, and the tablets accommodated are scattered, it is possible to stop the operation of the device, and to report an error.

The invention claimed is:

1. A tablet filling device, comprising:

a tablet cassette which has, in a cassette main body accommodating tablets, a rotor rotatably provided and having a groove for holding a tablet, and in which a discharge port for discharging the tablet held by the groove is formed in the cassette main body, with the cassette main body being provided with a worm gear in mesh with a gear fixed to a shaft of the rotor protruding from a bottom of the cassette main body; and a carrying member adapted to approach the tablet cassette accommodating tablets to be extracted while holding a tablet container, and equipped with a drive shaft to be engaged with the worm gear to rotate the rotor via the gear, wherein the worm gear is provided so as to be movable in an axial direction thereof, and wherein the tablet container is carried to the tablet cassette by the carrying member and, when a rotation of the rotor stops halfway through dispensing of tablets, the worm gear is moved in the axial direction by the drive shaft of the carrying member to cause the rotor to make reverse rotation.

2. A tablet filling device according to claim 1, further comprising an urging member for urging the worm gear in the axial direction thereof, wherein, at a time of reverse rotation of the rotor, the drive shaft of the carrying member is moved against the urging force of the urging member.

3. A tablet filling device according to claim 2, wherein, at the time of reverse rotation of the rotor, the direction in which the drive shaft of the carrying member is moved is a direction into which the drive shaft is drawn.

* * * * *